US007312166B2

(12) United States Patent
Thiriot

(10) Patent No.: US 7,312,166 B2
(45) Date of Patent: Dec. 25, 2007

(54) HIGH-VISIBILITY TEXTILE SURFACE

(75) Inventor: Laurent Thiriot, Colmar (FR)

(73) Assignee: Kermel, Colmar (FR)

( * ) Notice: Subject to any disclaimer, the term of this patent is extended or adjusted under 35 U.S.C. 154(b) by 59 days.

(21) Appl. No.: 10/415,747

(22) PCT Filed: Oct. 26, 2001

(86) PCT No.: PCT/FR01/03333

§ 371 (c)(1),
(2), (4) Date: Sep. 5, 2003

(87) PCT Pub. No.: WO02/36870

PCT Pub. Date: May 10, 2002

(65) Prior Publication Data

US 2004/0035489 A1 Feb. 26, 2004

(30) Foreign Application Priority Data

Nov. 3, 2000 (FR) ..... 00 14124

(51) Int. Cl.

| | |
|---|---|
| ***D03D 15/00*** | (2006.01) |
| ***D03D 13/00*** | (2006.01) |
| ***D03D 11/00*** | (2006.01) |
| ***A62B 17/02*** | (2006.01) |

(52) U.S. Cl. ..... 442/197; 442/203; 442/204; 442/205; 442/208; 442/209; 2/458

(58) Field of Classification Search ..... 139/420 R; 442/205, 208, 197, 203, 217, 189, 204, 209
See application file for complete search history.

(56) References Cited

U.S. PATENT DOCUMENTS

| | | | | |
|---|---|---|---|---|
| 3,458,506 | A * | 7/1969 | Bloom et al. | 548/219 |
| 3,556,165 | A * | 1/1971 | Jisa et al. | 139/383 R |
| 4,900,613 | A * | 2/1990 | Green | 442/189 |
| 4,920,000 | A * | 4/1990 | Green | 442/189 |
| 5,727,401 | A * | 3/1998 | Statham | 66/176 |
| 6,009,560 | A | 1/2000 | McKenney | |

FOREIGN PATENT DOCUMENTS

| | | |
|---|---|---|
| EP | 0 425 075 | 5/1991 |

* cited by examiner

*Primary Examiner*—Lynda Salvatore
(74) *Attorney, Agent, or Firm*—Buchanan, Ingersoll & Rooney, PC

(57) ABSTRACT

The invention concerns a textile surface having at least a high-visibility face. It is obtained from yarns or fibres of at least three types, of blanketing yarns or fibres, heat-stable yarns or fibres and high-visibility yarns or fibres. The surfaces provide excellent protection against fire and flames.

19 Claims, 1 Drawing Sheet

HIGH-VISIBILITY TEXTILE SURFACE

Figure 1:
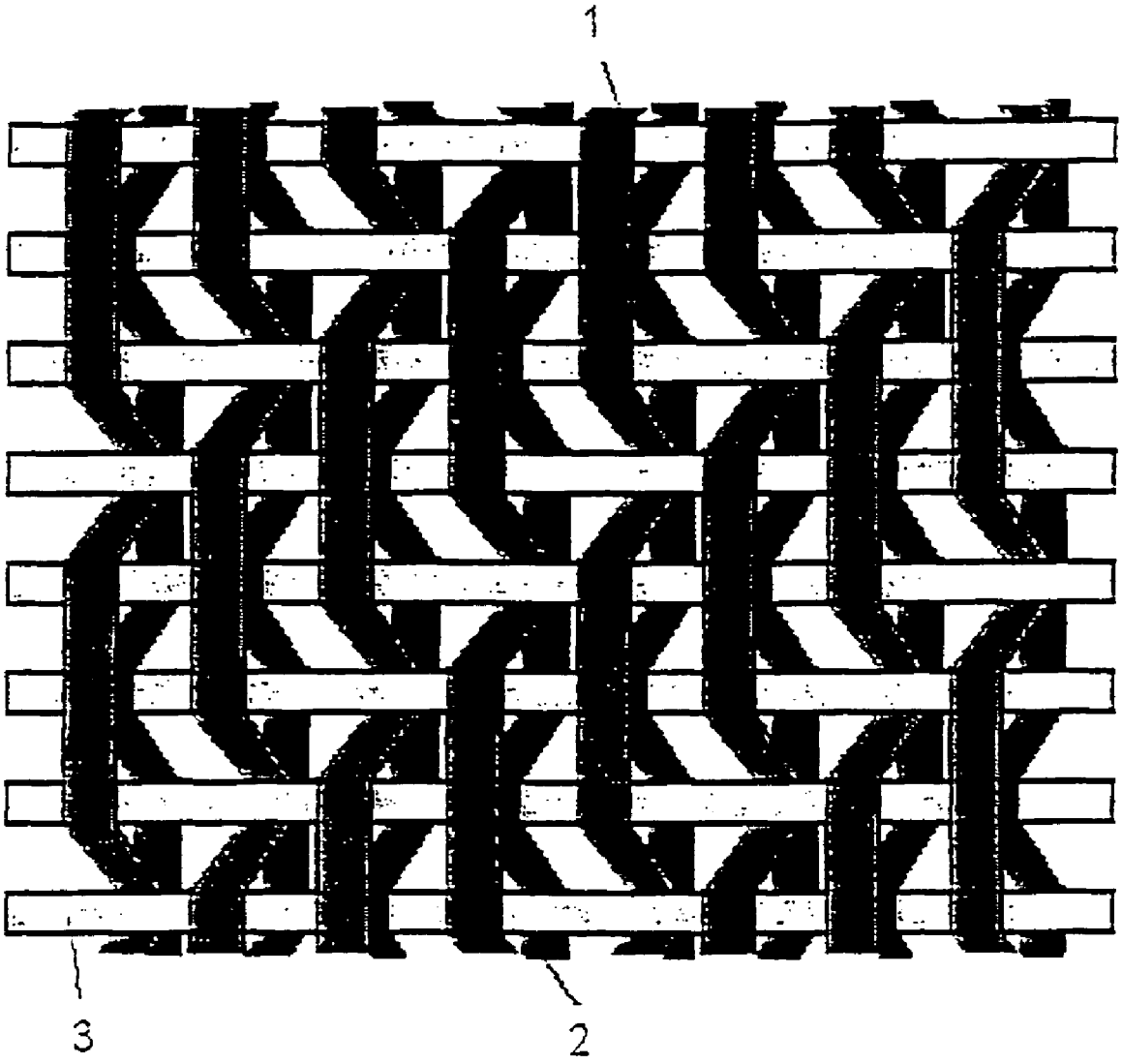

The present invention relates to the field of high-visibility textile surfaces. It relates more particularly to a woven textile article that can be used for making up high-visibility garments offering good heat and flame protection.

In some industrial fields, workers may be exposed to heat and flames. They must therefore wear protective garments made up from specially adapted textile surfaces. The protective garments are subject to standards intended to guarantee a level of protection. In particular, the EN 531 standard may be cited.

From another standpoint, it is sometimes required of garments to have high visibility so as to indicate the presence of workers. Thus, there are fabrics of fluorescent yellow, fluorescent orange and fluorescent red colors. The use of various colors in garments may serve as a distinctive sign and may make it possible, for example, to distinguish several crews on a work site or in a work area.

Thus yellow-colored yarns and orange-colored yarns are known which, when woven, make it possible to obtain a sufficient level of visibility. Visibility criteria are for example defined in the EN471 standard.

In many areas of activity, it is necessary for workers to wear garments that are both protective against the risks associated with fire and are highly visible. For this purpose, yellow fabric meeting the high-visibility and fire protection criteria are known. These fabrics are obtained by weaving intrinsically heat-resistant yarns containing yellow pigments. However, these fabrics have a relatively poor colorfastness.

This solution is not suitable for obtaining high-visibility orange-colored fabrics having heat protection properties. Orange-colored yarns giving sufficient fire protection are not known.

It is in fact necessary to point out that the problem of making up high-visibility protective garments, especially orange in color, the colorfastness of which is good, and acting to protect against the risks associated with fire, has no solution.

The object of the present invention is to provide a solution to this problem and to provide novel high-visibility textile surfaces offering protection against the risks associated with fire, especially novel yellow textile surfaces.

For this purpose, the invention provides a textile surface having at least one high-visibility face, the chromatic coordinates and the brightness factor of the face being chosen from:

the chromatic coordinates lying within the ellipse defined by the pairs of coordinates (X; Y) (0.610; 0.390), (0.544; 0.376), (0.579, 0.341), (0.655; 0.344) with a brightness factor β of greater than 0.40, this being a fluorescent orange color;

the chromatic coordinates lying within the ellipse defined by the pairs of coordinates (X; Y) (0.387; 0.610), (0.356; 0.494), (0.398, 0.452), (0.460; 0.540) with a brightness factor β of greater than 0.76, this being a fluorescent yellow color;

characterized in that it is obtained from at least three types of yarns or fibers:

yarns or fibers A: heat-stable yarns or fibers;

yarns or fibers B: smothering yarns or fibers causing gas evolution when they are exposed to a flame;

yarns or fibers C: yarns or fibers having optical properties such that a fabric produced solely from the yarns or fibers would have chromatic coordinates and a brightness factor chosen from:

the chromatic coordinates lying within the ellipse defined by the pairs of coordinates (X; Y) (0.610; 0.390), (0.544; 0.376), (0.579, 0.341), (0.655; 0.344) with a brightness factor β of greater than 0.40, the chromatic coordinates lying within the ellipse defined by the pairs of coordinates (X; Y) (0.387; 0.610), (0.356; 0.494), (0.398, 0.452), (0.460; 0.540) with a brightness factor β of greater than 0.76.

The textile surface has at least one high-visibility yellow or orange face. The high visibility is characterized by the chromatic coordinates and the brightness factor in accordance with the EN 471 standard. The methods of measuring the chromatic coordinates and the brightness factor are specified in the CIE 15:2:1968 standard.

The surface is obtained from yarns or fibers of several types, namely the yarns or fibers A, B and C. If a yarn or fiber exhibits simultaneously the characteristics of yarns or fibers of both types A and B, it falls within each of these types.

The surface is obtained, for example, by weaving or knitting, with a construction such that the yarns or fibers C appear on the high-visibility face. According to one advantageous embodiment, the yarns or fibers A are placed in the textile surface in two separate directions, for example in two weaving directions.

The term "yarn" is understood to mean a continuous multifilament object, a continuous stable fiber yarn obtained from only one type of fiber, or from a mixture of fibers, for example fibers A and B as an intimate mixture, or fibers A or B with other fibers. It may also mean a continuous yarn obtained by assembling several yarns.

The yarns or fibers A are heat stable. They are yarns or fibers whose shrinkage and loss of mechanical properties are limited after exposure to a flame for a short time (of around 3 to 4 seconds). As examples, mention may be made of yarns or fibers based on aramids, such as polyamide-imide, polyparaphenylene terephthalamide, polymetaphenylene isophthalamide, polyimides, polybenzimidazole (PBI) and polyparaphenylene-2,6-benzobisoxazole (PBO). Yarns A may consist of a mixture of fibers, an intimate mixture or a core/shell mixture (core-type stable fiber yarns). It may, for example, be a mixture of polyamide-imide fibers and fire-retarded viscose fibers, optionally with paraphenylene terephthalamide fibers. The yarns may also consist of polymetaphenylene isophthalamide fibers or mixtures of these fibers with, especially, polyparaphenylene terephthalamide fibers.

The yarns or fibers B are smothering yarns or fibers, causing gas evolution when they burn. The gas evolved is preferably a gas different from oxygen. These yarns or fibers inhibit the combustion of the neighboring yarns or fibers. The gas evolution is generally the result of decomposition of the constituent material of the yarn or fiber. It may also result from an additive or a size. As examples of smothering fibers, modacrylic fibers and PPAN (preoxidized polyacrylonitrile) fibers may be mentioned. It is possible to use composite yarns comprising at least two twisted yarns, a heat-stable yarn and a yarn comprising smothering fibers, by themselves or as a mixture. It is also possible to use an untwisted yarn, comprising smothering fibers, by themselves or as a mixture.

As examples of yarns causing gas evolution, it is possible to use:

modacrylic or PPAN stable fiber yarns;

stable fiber yarns based on an intimate mixture comprising modacrylic or PPAN fibers and heat-stable fibers chosen, for example, from aramids, polybenzimidazole, PBO, phenolic resin fibers, glass fibers, carbon fibers or melamine fibers;

twisted yarns comprising a yarn composed of heat-stable fibers, by themselves or as a mixture, and one or more of the stable fiber yarns described above.

As examples of stable fiber yarns composed of modacrylic fibers, mention may be made of PROTEX M or S fibers sold by Kaneka, LUFNEN VF1 and VE1 fibers and SUPERVALZER fibers.

The yarns or fibers B preferably have a limiting oxygen index of greater than 30%.

The yarns or fibers C are orange- or yellow-colored yarns or fibers, having optical properties such that a fabric produced solely from these yarns or fibers would have chromatic coordinates and a brightness factor chosen from:

the chromatic coordinates lying within the ellipse defined by the pairs of coordinates (X; Y) (0.610; 0.390), (0.544; 0.376), (0.579, 0.341), (0.655; 0.344) with a brightness factor β of greater than 0.40, these being fluorescent orange-colored yarns or fibers;

the chromatic coordinates lying within the ellipse defined by the pairs of coordinates (X; Y) (0.387; 0.610), (0.356; 0.494), (0.398, 0.452), (0.460; 0.540) with a brightness factor β of greater than 0.76, these being fluorescent orange-colored yarns or fibers.

They may for example be yarns or fibers based on polyethylene terephthalate comprising a pigment introduced before spinning and giving the yarns or fibers the required color. Advantageously, the pigment is orange in color. They may for example be orange yarns sold by Trevira under the reference TEXTURGARN TYP 501 V.

According to one particular embodiment of the invention, the surface is obtained by weaving at least three families of yarns. The families of yarns define, at least in part, the structure and the construction of the surface. Each family may comprise yarns or fibers of different types.

A first family is the family of upper yarns. This family constitutes a warp or a weft appearing on the high-visibility face. It comprises yarns or fibers C. Optionally, it may also include yarns or fibers A and/or B.

A second family is the family of lower yarns. This family consists of yarns parallel to the family of lower yarns. The lower yarns do not appear on the high-visibility face.

A third family is the family of transverse yarns. This family consists of yarns perpendicular to the lower yarns. It is woven with at least the family of lower yarns. It may also be woven with other families of yarns, for example with the family of upper yarns or with another family of fibers, different from the family of upper yarns and from the family of lower yarns.

According to one advantageous embodiment, at least one family chosen from the family of lower yarns and the family of transverse yarns comprises yarns or fibers B, and the family of lower yarns and the family of transverse yarns each comprise yarns or fibers A. According to this embodiment, one of the families therefore comprises both yarns or fibers A and yarns or fibers B. This may be a yarn spun from fibers A and fibers B. This family may, for example, consist of stable fiber yarns of fibers A and B as an intimate mixture. According to a preferred embodiment, the family of transverse yarns consists of yarns spun from fibers A and B as an intimate mixture, and the family of lower yarns consists of yarns obtained from heat-stable fibers, by themselves or as a mixture, for example an intimate mixture with other fibers. The latter yarns may, for example, be intimate mixtures of aramid fibers and viscose-based fire-retarded fibers.

The surface may, for example, be obtained by double-warp or double-weft weaving. These structures are known. In the case of double-warp weaving, the family of upper yarns constitutes the upper warp, the family of lower yarns constitutes the lower warp and the family of transverse yarns constitutes the weft. For a double-weft structure, the family of upper yarns constitutes the upper weft, the family of lower yarns constitutes the lower weft and the family of transverse yarns constitutes the warp.

In the particular embodiment that the double-warp weaving and the double-weft weaving constitute, the family of lower yarns is not visible on the high-visibility face. On the other face of the surface, the family of upper yarns is not visible. Both faces are respectively woven, consisting of transverse yarns with upper and lower yarns respectively. The weaves may be weaves derived from cloth, satin or twill. A preferred weave is the 4 double-warp or double-weft twill weave.

The proportion by weight in the textile surface of yarns or fibers A is preferably greater than 35%. The proportion by weight of yarns or fibers C, for example those based on polyethylene terephthalate, is preferably less than 50% and even more preferably less than 30%. The ratio by weight of yarns or fibers B to yarns or fibers C, for example those based on polyethylene terephthalate, is preferably between 25/75 and 75/25.

According to one embodiment of the invention, all the yarns of the family of transverse yarns are yarns obtained by assembling a yarn A with a yarn B, or by an intimate mixture of fibers A and fibers B.

According to one advantageous embodiment, all the yarns of the family of lower yarns are yarns A.

The yarns of the family of upper yarns preferably cover at least 70% of the upper face of the surface.

Other details and advantages of the invention will become more clearly apparent in the light of the example given below without any limiting effect, and illustrated by FIG. 1.

A fabric is woven using the technique of double-warp weaving, based on a 4 twill weave. The yarns used are the following:

upper warp (1): yarns based on fluorescent orange bulk-tinted polyester sold by Trivera under the name 167/48*1 dtex TEXTILGARN TYP 501 V;

lower warp (2): stable fiber yarn composed of an aramid (polyamide-imide)/viscose FR intimate mixture in the proportion by weight of 70/30;

weft (3): stable fiber yarn consisting of an aramid (polyamide-imide)/PROTEX (smothering yarn sold by KANECA) intimate mixture in the proportion by weight of 70/30.

FIG. 1 shows schematically the structure of the fabric.

The fabric was subjected to the tests defined in EN 471 and EN 531 standards. The fabric conformed to these standards, with the classification A, B1, C1 and E1 in respect of the EN 531 standard.

The invention claimed is:

1. A textile comprising a surface having at least one high-visibility face, wherein chromatic coordinates and brightness factor of the face are chosen from:

(1) a fluorescent orange color having chromatic coordinates lying within the ellipse defined by the pairs of coordinates (X; Y) (0.610; 0.390), (0.544; 0.376), (0.579, 0.341), (0.655; 0.344) with a brightness factor β of greater than 0.40; or (2) a fluorescent yellow color having chromatic coordinates lying within the ellipse defined by the pairs of coordinates (X; Y) (0.387; 0.610), (0.356; 0.494), (0.398, 0.452), (0.460; 0.540) with a brightness factor β of greater than 0.76;

wherein said surface comprises at least three types of yarns or fibers (A), (B) and (C), wherein:

(A) comprises heat-stable yarns or fibers;

(B) comprises yarns or fibers which evolve a smothering gas when exposed to a flame, said gas inhibiting the combustion of yarns or fibers (A) and (C):

(C) comprises yarns or fibers having fluorescent orange or yellow colored pigments and having chromatic coordinates and a brightness factor such that a fabric produced solely from yarns or fibers C would have chromatic coordinates and a brightness factor chosen from:

chromatic coordinates lying within the ellipse defined by pairs of coordinates (X; Y) (0.60; 0.390), (0.544; 0.376), (0.579, 0.341), (0.655; 0.344) with a brightness factor β of greater than 0.40; or chromatic coordinates lying within the ellipse defined by pairs of coordinates (X; Y) (0.387; 0.610), (0.356; 0.494), (0.398, 0.452), (0.460; 0.540) with a brightness factor β of greater than 0.76.

2. The textile of claim 1, wherein the surface is woven and comprises at least three families of yams:

a family of upper yams, constituting a warp or a weft, appearing on the high-visibility face;

a family of lower yams, parallel to the family of upper yarns and not appearing on the high-visibility face;

a family of transverse yarns, perpendicular to the family of lower yarns and woven with at least the family of lower yams;

at least one family chosen from the family of lower yarns or the family of transverse yams comprising yarns or fibers B;

a family of transverse yarns or the family of lower yarns comprising yarns or fibers A; and a family of upper yarns comprises yarns or fibers C and optionally yarns or fibers A or B.

3. The textile of claim 2, wherein the surface is composed of double-warp or double-weft weaving, the family of upper yarns constituting an upper warp in the case of double-warp articles or an upper weft in the case of double-weft articles, the family of lower yarns constituting a lower warp in the case of double-warp articles or a lower weft in the case of double-weft articles, and the family of transverse yams constituting the weft in the case of double-warp yarns or the warp in the case of double-weft articles.

4. The textile of claim 2, wherein the at least one family chosen from the family of lower yarns and the family of transverse yarns comprises yarns spun from fibers A and from fibers B.

5. The textile of claim 2, wherein the family of transverse yarns consists of yarns spun from fibers A and fibers B, as an intimate mixture, and the family of lower yarns consists of yarns spun from fibers A, by themselves or mixed with other fibers.

6. The textile of claim 1, wherein the yarns or fibers B are based on modacrylic or preoxidized polyacrylonitrile fibers.

7. The textile of claim 1, wherein the yarns or fibers A are based on a synthetic material selected from the group consisting of polyamide-imide, polyparaphenylene terephthalamides, polymetaphenylene isophthalamide, polybenzimidazole and polyparaphenylene-2,6-benzobisoxazole.

8. The textile of claim 1, wherein the yarns or fibers C are based on polyethylene terephthalate and further comprise a pigment introduced before spinning, which provides the required color.

9. The textile of claim 1, wherein the yarns or fibers C cover at least 70% of the high-visibility face.

10. The textile of claim 1, wherein the yarns or fibers C represent less than 35% by weight of the surface.

11. The textile of claim 1, wherein the yarns or fibers B have a limiting oxygen index greater than 30%.

12. A high visibility, heat-protective garment comprising the textile article of claim 1.

13. A high visibility, heat-protective garment comprising the textile article of claim 2.

14. The high visibility, heat-protective garment of claim 12, wherein the textile article is visible on the outer surface of the garment.

15. The high visibility, heat-protective garment of claim 13, wherein the textile article is visible on the outer surface of the garment.

16. The article of claim 1, wherein the yarns or fibers (C) having fluorescent orange or yellow colored pigments are based on polyethylene terephthalate comprising a pigment.

17. The article of claim 2, wherein the yarns or fibers (C) having fluorescent orange or yellow colored pigments are based on polyethylene terephthalate comprising a pigment.

18. The article of claim 1, wherein the yarns or fibers (C) having fluorescent orange or yellow colored pigments comprise TEXTURGARN TYP 501 V.

19. The article of claim 2, wherein the yarns or fibers (C) having fluorescent orange or yellow pigments comprise TEXTURGARN TYP 501 V.

* * * * *